United States Patent [19]

Gerhard

[11] Patent Number: 4,753,363

[45] Date of Patent: Jun. 28, 1988

[54] TANK ARRANGEMENT

[75] Inventor: Helmut Gerhard, Weitefeld, Fed. Rep. of Germany

[73] Assignee: Westerwaelder Eisenwerk Gerhard GmbH, Weitefeld, Fed. Rep. of Germany

[21] Appl. No.: 60,007

[22] Filed: Jun. 9, 1987

[30] Foreign Application Priority Data

Jul. 18, 1986 [DE] Fed. Rep. of Germany ..... 3624430

[51] Int. Cl.[4] ..... B65D 88/06

[52] U.S. Cl. ..... 220/71; 220/1 B; 220/5 A

[58] Field of Search ..... 220/71, 1 B, 5 A

[56] References Cited

U.S. PATENT DOCUMENTS 1,688,868 10/1928 Horton ..... 220/1 B 3,730,384 5/1973 Ramme ..... 220/1 B X 4,065,022 12/1977 Cainaud ..... 220/1 B X 4,147,269 4/1979 Werts ..... 220/1 B 4,307,812 12/1981 Gerhard .

4,603,788 8/1986 Gerhard .

*Primary Examiner*—Steven M. Pollard

*Attorney, Agent, or Firm*—Barnes & Thornburg

[57] ABSTRACT

In a tank container, a support member 20, which is inserted between a reinforcing ring 11 of the tank 10 and a lower cross-strut 17 of the container framework is composed of two sheet-metal elements 21, 22 which are bent towards each other and which may be fitted in the spandrel space formed between reinforcing ring 11 and cross-strut 17 and welded to each other in such a way as to result in a central rigid rectangular tube having softer surface elements arranged on the two outer sides for preventing peak stresses.

7 Claims, 2 Drawing Sheets

TANK ARRANGEMENT

DESCRIPTION

Figure 1:
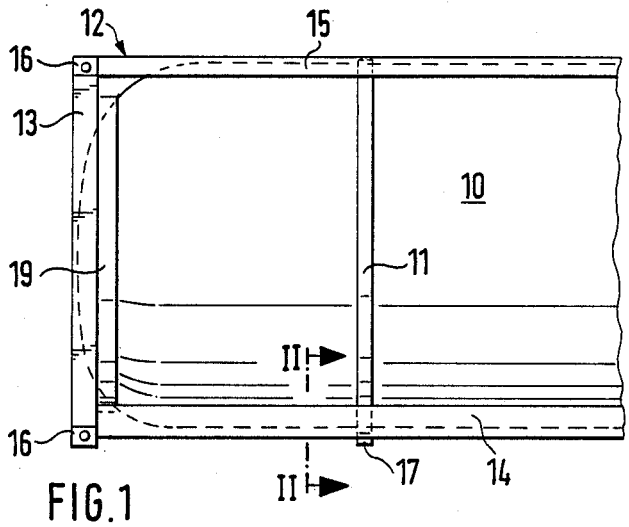

The forces that may occur during the transport of a tank container and which are caused both by the mass of the tank content and by distortions and accelerations of the vehicle, are quite considerable and may result in the tank becoming oval and in fatigue fractures in case of improper mounting. Frequently, the vehicle design does not permit introduction of the overall load of the tank container into twistlocks provided on the vehicle platform merely via the four bottom corner fittings. For this reason an additional support for the tank container in a central portion thereof may become necessary. When such tank containers are equipped with heavy bottom side rails, such a support should have only little dead weight so that the tare weight of the overall container is not unduly increased any further. A simple cross-strut extending beneath the cross-section of the tank is normally insufficiently rigid due to the limited available headroom and therefore has to be supported relative to the tank.

GB-A-No. 2,145,397 (corresponding to U.S. Pat. No. 4,603,788) discloses a prior art tank arrangement in which a support member is mounted between a reinforcing ring of the tank and a diagonally extending strut provided in the base structure of the container framework. The support member is composed of two bent sheet-metal elements which for assembly are pushed from either side against the reinforcing ring and welded thereto with their foot portions being welded to the diagonal strut.

It is an object of the present invention to increase the load bearing capacity of the support member while retaining the advantage of easy assembly and of the use of simply designed sheet-metal elements.

A tank arrangement which meets with this object comrises a tank provided with reinforcing rings, a supporting structure including lower beams, and support members inserted between said reinforcing rings and said lower beams, each support member including two bent sheet-metal elements disposed with their bending lines extending between the tank and the corresponding lower beam, each said element having a main portion extending transversely to the longitudinal axis of the tank with an upper edge region secured to a side face of a corresponding reinforcing ring, a flange portion extending at an angle relative to the main portion and having a width corresponding to the width of the respective beam, each said flange portion being recessed at its bottom edge and welded to the main portion of the respective other sheet-metal element of the same support member, and a lower portion secured to a corresponding one of said lower beams, wherein the flange portions of the two sheet-metal elements of each support member have different heights.

In this arrangement, the two sheet-metal elements during assembly cooperate to constitute an upright rectangular tube which, due to this geometrical configuration, exhibits excellent stability and may be assembled such that the top and bottom edges thereof fit exactly in the gap between a reinforcing ring of the tank and a beam of the base structure, while no special tolerances need be considered for the remaining assembly of the tank container or for the fabrication of the sheet metal elements. Rather, the exact fit will result automatically upon insertion of the sheet-metal elements due to their configuration.

Preferably, the width of the main portion of each sheet-metal element extends beyond the location at which the flange portion of the respective other sheet-metal element is welded to it. This results in the significant additional advantage that the support member as a whole is extremely rigid and has a high load bearing capacity in its central portion, while it is relatively soft in the vicinity of its outer ends, so that there is no risk of cracks being formed on the reinforcing ring or the tank due to continuous stress. Rather, the outer and inner end points of the support means on the reinforcing ring are capable of elastically absorbing the vibrations of the tank shell during transport.

Further modifications of the invention are advantageous from the aspects of increased stability, proper load distribution and easy manufacture of the sheet-metal elements.

Figure 4:
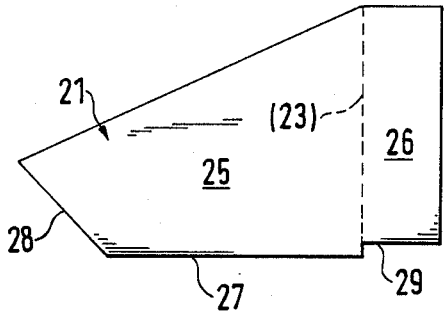
Figure 5:
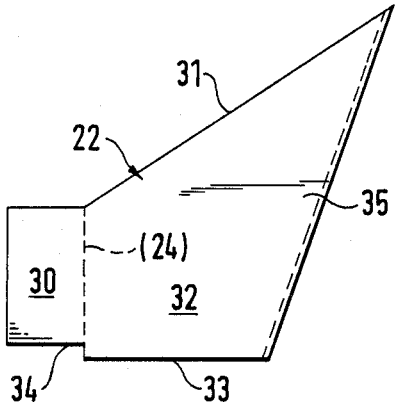
Figure 2:
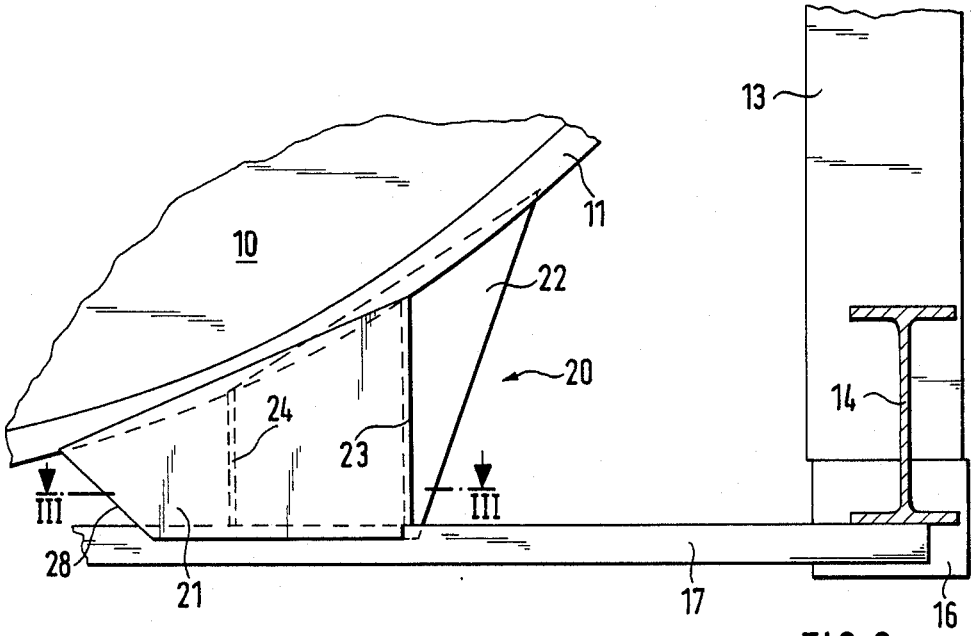
Figure 3:
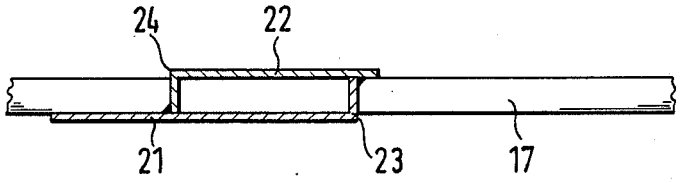

Preferred embodiments of the invention will be described in detail with reference to the drawing, in which FIG. 1 is a schematic partial side view of a tank container, FIG. 2 is a partial cross-sectional view along the line II—II of FIG. 1, FIG. 3 is a horizontal section through the support member shown in FIG. 2 along the line III—III, and FIGS. 4 and 5 show the blanks for the two sheet-metal elements to form the support member shown in FIGS. 2 and 3.

In the tank container illustrated in FIG. 1, the tank 10 is provided along its length with reinforcing rings 11 of which one is illustrated. The framework 12 includes corner supports 13, bottom longitudinal rails 14 and top longitudinal rails 15. The corner supports and longitudinal rails are connected to each other by means of corner fittings 16. The relatively heavy bottom rails 14 are interconnected, in conformity with standards, at intermediate load-transmitting locations by means of cross-struts 17, only one of which is shown in FIG. 1 which extends in the vertical plane of one of the reinforcing rings 11 of the tank 10.

Since the cross-strut 17 extends beneath the lowermost point of the reinforcing ring 11 and since the volume available for the cylindrical tank 10 within the overall dimensions of the framework 12 should be influenced as little as possible, the height of the cross-strut 17 is relatively small. The width of the cross-strut 17 is selected so as to correspond to that of the reinforcing ring 11.

The main support between the tank 10 and the end structures of the framework 12 is through annular saddle mountings 19 or other known connecting means inserted between each of the end structures and the respective tank end 18.

The cross-strut 17 is connected to the reinforcing ring 11 extending in the same plane by means of two support members 20, one of which is shown on an enlarged scale in FIGS. 2 and 3. Each support member 20 is composed of two sheet-metal elements 21 and 22 bent along respective vertical bending lines 23 and 24. In FIG. 4 and FIG. 5 the blanks for the sheet-metal elements 21 and 22 are illustrated prior to bending.

As shown in FIG. 4, the sheet-metal element 21 includes a trapezoidal main portion 25 and a flange portion 26 connected thereto along the bending line 23. This line 23, along which the sheet-metal element 21 is bent rearwardly, as viewed in the plane of the drawing, to form the support member 20 of FIG. 2, extends normal to the bottom edge 27 of said main portion 25. The upper straight edge opposite said edge 27 extends at an angle which corresponds to the mean inclination of the reinforcing ring 11 in the region where the element 21 abuts the reinforcing ring 11. The fourth edge 28 of the main portion 25, which in the assembled condition faces the centre of the container framework, likewise extends at an angle so that the width of the main portion 25 of the element 21 increases from bottom to top, i.e., from the cross-strut 17 to the reinforcing ring 11.

The width of the flange portion 26 corresponds to the width of the cross-stud 17 and of the reinforcing ring 11. The bottom part of the flange portion 26 is cut away to form a recess 29 with respect to the lower edge 27 of the main portion 25. The height of this recess 29 is smaller than that of the cross-strut 17. The height (or length) of the flange portion 26 corresponds to the spacing between the cross-strut 17 and the reinforcing ring 11 in the assembled condition of the sheet-metal element 21, as measured normal to the cross-strut 17.

The shape of the sheet-metal element 22 illustrated in FIG. 5 is generally similar to that of the sheet-metal element 21 shown in FIG. 4, but it is illustrated such that, for forming the support member 20 shown in FIG. 2, bending along the line 24 is done to the front relative to the plane of the drawing of FIG. 5. The element 22 differs from the element 21 mainly in that the height (or length) of the flange portion 30 is smaller than that of the flange portion 26, because the flange portion 30 of the element 22 in the assembled condition is positioned farther inwardly, where the distance between the reinforcing ring 11 and the cross-strut 17 is smaller. Moreover, the upper, straight-line edge 31 of the main portion 32 is inclined relative to the lower edge 33 at a steeper angle to correspond to the mean inclination of the reinforcing ring 11 in the assembly region of the element 22, which is generally farther removed towards the outside. The recess 34 of the element 22 has the same dimensions as the recess 29 of the element 21.

In assembly, the tank 10 is initially connected to the end structures of the framework 12 by means of the annular saddle mountings 19. Thereupon the support members 20 are inserted. To this end, first one of the two sheet-metal elements, e.g. the element 21, is moved along the direction of the longitudinal axis of the tank against the corresponding side faces of the reinforcing ring 11 and the cross-strut 17 and is then shifted to the left in the direction of the cross-strut 17 according to FIG. 2 until the upper edge of the flange portion 26 abuts the outer surface of the reinforcing ring 11 and the lower, recessed edge of the flange portion 26 is flush with the upper face of the cross-strut 17. In this position the lower edge 27 is welded to the cross-strut 17 and the opposite upper edge is welded to the side face of the reinforcing ring 11. Also, the upper and the lower edge of the flange portion 26 are welded to the faces of reinforcing ring 11 and cross-strut 17 which they contact.

Thereupon the other sheet-metal element, in this case the element 22, is similarly inserted, but from the opposite side, and shifted to the left according to FIG. 2 until the upper and lower edges of the flange portion 30 thereof engage the outer face of the reinforcing ring 11 and the upper face of the cross-strut 17, respectively. The element 22 is welded to the reinforcing ring 11 and the cross-strut 17 in the same way as the element 21. Moreover, the vertical outer edge of the flange portion 26, 30 of each element 21, 22 is welded to the opposing inner surface of the main portion 25, 32 of the respective other element 22, 21.

The thus completed support member 20 comprises an interior part which according to FIG. 3 has the cross-section of a rectangular tube and is therefore stable and has a good load-bearing capacity. The design of the two sheet-metal elements 21, 22 and the described procedure during assembly result in said rectangular tube accurately fitting with its load-bearing edges exactly into the gap between reinforcing ring 11 and cross-strut 17 even if the distance between tank 10 and base structure of the framework 12 is subject to considerable assembly deviations and the shapes of the sheet-metal elements 21, 22 themselves are subject to significant manufacturing tolerances.

Outside the mentioned central rectangular tube, the support member 20 comprises soft areas which are formed by the outwardly projecting parts of the main portions 25, 32 and which contribute to preventing peak stresses at the end points of the connections between the support member 20 and the reinforcing ring 11, thus at the tank 10 itself.

While, in the foregoing description, the invention has been explained with reference to a tank container, it is not limited thereto and may also be used in a tank lorry in which the mentioned cross-strut would be part of the vehicle body.

Furthermore, the said cross-strut may be a fork lift channel or a container framework member provided at its outer ends with grappler edges for handling the container. If, in this case, the structural member constituting the cross-strut has a larger width than is common for tank reinforcement rings, two reinforcement rings may be provided in side-by-side relationship, and the sheet-metal elements may be welded to those end faces of these two reinforcing rings which are remote from each other.

In the above embodiment the sheet-metal elements 21, 22 further result in the rectangular four-sided tube section shown in FIG. 3. Alternatively, they may be designed so as to result in a rhomboidal or trapezoidal section. Moreover, a design may be appropriate in which the bending lines 23, 25 are not parallel, as shown in FIG. 2, but diverge towards the top or bottom. In a further modification both bending lines 23, 24 may extend radially to the tank axis or parallel to a radial line, in which case forces are transmitted perpendicularly to the tank shell and obliquely to the cross-strut 17.

The edge 28 illustrated as a straight edge in FIG. 4 is relatively rigid and, if required, may be made softer by being concave curved. In the opposite case, this outer free edge of one or each sheet-metal element 21, 22 may be made more rigid by reinforcing such as by a second bend 35 indicated in FIG. 5 in the sheet-metal element 22.

I claim:

1. A tank arrangement comprising a tank provided with reinforcing rings, a supporting structure including lower beams, and support members inserted between said reinforcing rings and said lower beams, each support member including two bent sheet-metal elements disposed with their bending lines extending between the tank and the corresponding lower beam, each said element having a main portion extending transversely to the longitudinal axis of the tank with an upper edge region secured to a side face of a corresponding reinforcing ring, a flange portion extending at an angle relative to the main portion and having a width corresponding to the width of the respective beam, each said flange portion being recessed at its bottom edge and welded to the main portion of the respective other sheet-metal element of the same support member, and a lower portion secured to a corresponding one of said lower beams, wherein the flange portions of the two sheet-metal elements of each support member have different heights.

2. The tank arrangement of claim 1, wherein the width of the main portion of each sheet-metal element extends beyond the location at which the flange portion of the respective other sheet-metal element is welded to it.

3. The tank arrangement of claim 1, wherein the main portion of each sheet-metal element has a trapezoidal shape with its width increasing from the lower beam towards the reinforcing ring.

4. The tank arrangement of claim 1, wherein the main portion of each sheet-metal element engages the reinforcing ring with a straight edge portion.

5. The tank arrangement of claim 1, wherein the flange portions of both sheet-metal elements have rectangular shapes.

6. The tank arrangement of claim 1, wherein said bending lines of the sheet-metal elements are inclined relative to the cross-strut.

7. The tank arrangement of claim 6, wherein the bending lines of both sheet-metal elements extend substantially radially to the tank.

* * * * *